US006720729B1

(12) United States Patent
Choi et al.

(10) Patent No.: US 6,720,729 B1
(45) Date of Patent: Apr. 13, 2004

(54) FIELD EMISSION DISPLAY WITH ELECTRON EMISSION MEMBER AND ALIGNMENT MEMBER

(75) Inventors: Kwi-Seok Choi, Suwon-si (KR); Sang-Jin Lee, Suwon-si (KR); Jae-Myung Kim, Suwon-si (KR); Chang-Wook Kim, Seongnam-si (KR); Joong-Woo Nam, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 09/525,505

(22) Filed: Mar. 15, 2000

(30) Foreign Application Priority Data

Mar. 22, 1999 (KR) ..... 1999-9722

(51) Int. Cl.[7] ..... H01J 1/62; H01J 63/04

(52) U.S. Cl. ..... 313/496; 313/346 R; 313/310; 313/311

(58) Field of Search ..... 313/446, 445, 313/497, 346 R, 310, 311, 496, 495

(56) References Cited

U.S. PATENT DOCUMENTS 5,595,519 A * 1/1997 Huang ..... 445/24
5,708,327 A * 1/1998 O'Boyle ..... 313/495
5,872,422 A * 2/1999 Xu et al. ..... 313/311
5,892,323 A * 4/1999 Zimmerman ..... 313/495
6,008,577 A * 12/1999 Rasmussen et al. ..... 313/496
6,097,139 A * 8/2000 Tuck et al. ..... 313/310
6,224,730 B1 * 5/2001 Rasmussen ..... 204/490
6,239,547 B1 * 5/2001 Uemura et al. ..... 313/495

* cited by examiner

*Primary Examiner*—Nimeshkumar D. Patel
*Assistant Examiner*—Kevin Quarterman
(74) *Attorney, Agent, or Firm*—Christie, Parker & Hale LLP

(57) ABSTRACT

A field emission display has a cathode, an emitter formed on the cathode, and an anode spaced apart from the cathode at a predetermined distance. The emitter includes an electron emission member having a longitudinal dimension, and an alignment member for aligning the electron emission member. The alignment member is formed with a magnetic material. The electron emission member is aligned by the alignment member such that the longitudinal dimension of the electron emission member is vertically extended from the cathode toward the anode. The electron emission member may be formed with carbon fibers or graphite particles. The magnetic material is coated on the surface of the carbon fibers or incorporated into the internal structure of the carbon fibers.

15 Claims, 3 Drawing Sheets

FIELD EMISSION DISPLAY WITH ELECTRON EMISSION MEMBER AND ALIGNMENT MEMBER

BACKGROUND OF THE INVENTION (a) Field of the Invention

The present invention relates to a field emission display and a method of fabricating the same and, more particularly, to a field emission display which effectively enhances electron emitting characteristics.

(b) Description of the Related Art

Generally, field emission displays (FEDs) are display devices where electrons are liberated from an emitter on a cathode by quantum mechanical tunneling and impinge upon phosphors on an anode, thereby producing a predetermined screen image.

A tip-based emitter and a broad area emitter may be used for such an emitter. The tip-based emitter is provided with a gate electrode, and electrons are emitted from the tip-based emitter due to differences in the applied voltages to the cathode and the gate electrode. In contrast, the broad area emitter does not have such a gate electrode, and electrons are emitted from the broad area emitter due to differences in the applied voltages to the cathode and the anode.

The tip-based emitter is prepared by forming an insulating layer and a gate electrode on the cathode, etching the insulating layer and the gate electrode, and depositing an electron emitting material such as molybdenum and silicon onto the etched space. The resulting tip-based emitter is provided with a large number of micro-tips corresponding to pixels.

However, due to the micro-tip structure of the tip-based emitter, it becomes difficult to uniformly form electron emitting tips over the entire display area and to employ the tip-based emitter for use in large area display devices. Furthermore, such a tip-based emitter is vulnerable to damage and necessarily involves extremely sophisticated tip formation techniques, resulting in increased production cost.

Alternatively, it has been suggested that a broad area emitter, using diamond, diamond-like carbon, graphite particles or carbon fibers, could replace the tip-based emitter with improved electron emitting characteristics.

Particularly, it is known that the carbon fiber-based emitter has a relatively good electron emitting characteristic. Such a carbon fiber-based emitter is usually prepared by cutting and pulverizing carbon fibers to make a carbon fiber powder, adding a frit and a binder to the carbon fiber powder to make an emitter paste, and printing the emitter paste onto a cathode. However, it turns out that the carbon fiber components are non-uniformly distributed over the display area. Such a non-uniform distribution of the carbon fiber components makes it difficult to obtain the desired electron emitting effect. This is presumably because the pointed end portion of the carbon fiber has a locally intensified electron emitting property and, due to the non-uniform distribution of the carbon fiber components, the pointed end portion of the carbon fiber cannot be directed toward the display screen.

This problem is also present in the graphite powder-based emitter where plate-shaped graphite particles are disorderly over-layered.

SUMMARY OF THE INVENTION

It is an object of the present invention to provide a field emission display which can effectively enhance electron emitting characteristics with an emitter having uniformly aligned electron emitting components.

These and other objects may be achieved by a field emission display including first and second substrates spaced apart from each other at a predetermined distance. The first substrate has a top surface, and the second substrate has a bottom surface. The top surface of the first substrate faces the bottom surface of the second substrate. A cathode is disposed on the top surface of the first substrate. The cathode has a top surface and a bottom surface. The bottom surface of the cathode contacts the top surface of the first substrate. An anode is disposed on the bottom surface of the second substrate. The anode has a top surface and a bottom surface. The top surface of the anode contacts the bottom surface of the second substrate. A phosphor screen is formed on the bottom surface of the anode. An emitter is formed on the top surface of the cathode. The emitter faces the phosphor screen.

The emitter includes an electron emission member having a longitudinal dimension, and an alignment member for aligning the electron emission member. The alignment member is formed with a magnetic material. The electron emission member is aligned by the alignment member such that the longitudinal dimension of the electron emission member is vertically extended from the cathode toward the phosphor screen of the anode.

The electron emission member may be formed with carbon fibers or graphite particles. The magnetic material is coated on the carbon fibers or graphite particles. Alternatively, the magnetic material may be incorporated into the internal structure of the carbon fibers or graphite particles.

A method of fabricating the field emission display includes the steps of 1) forming a cathode and an anode each through depositing a conductive layer onto a suitable substrate, 2) preparing an emitter paste through mixing an electron emitting material, a magnetic material and additives such as a frit and a binder, 3) screen-printing the emitter paste onto the cathode, 4) aligning the electron emitting material by forming a magnetic field in the vicinity of the printed emitter paste such that the electron emitting material can be arranged substantially vertical to the cathode, 5) solidifying the emitter paste by drying and burning it, and 6) sealing the substrates into one body.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 1:
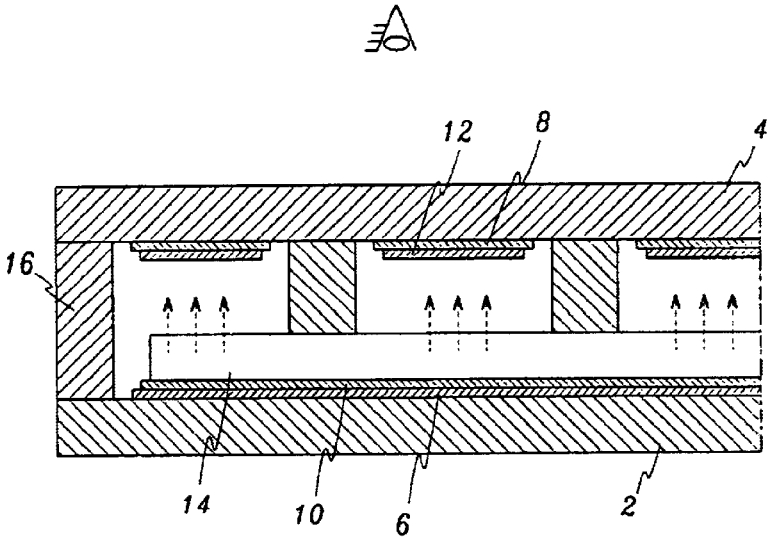
FIG. 1 is a cross sectional view of a field emission display with an emitter according to a preferred embodiment of the present invention.

FIG. 1 is a cross sectional view of a field emission display according to a first preferred embodiment of the present invention. As shown in FIG. 1, the field emission display includes a first substrate 2 with a top surface, and a second substrate 4 spaced apart from the first substrate 2 at a predetermined distance. The second substrate 4 has a bottom surface facing the top surface of the first substrate 2. A cathode 6 is disposed on the top surface of the first substrate 2, and an anode 8 is disposed on the bottom surface of the second substrate 4. The cathode 6 has a plurality of linear electrode portions which are arranged parallel to each other, and the anode 8 has another plurality of linear electrode portions. The linear electrode portions of the anode 8 are formed to be perpendicular to those of the cathode 6.

An emitter 10 is formed on a top surface of the cathode 6, and a phosphor screen 12 is formed on a bottom surface of the anode 8 such that it faces the emitter 10.

In this structure, when a predetermined pattern of voltage is applied onto the cathode 6 and another predetermined pattern of voltage onto the anode 8, the voltage difference between the cathode 6 and the anode 8 induces an electric field to be applied onto the emitter 10. With the application of the electric field, electrons (indicated by dotted line arrows in the drawing) are liberated from the emitter 10, and impinge upon phosphors on the phosphor screen 12, thereby producing a screen image.

Figure 2:
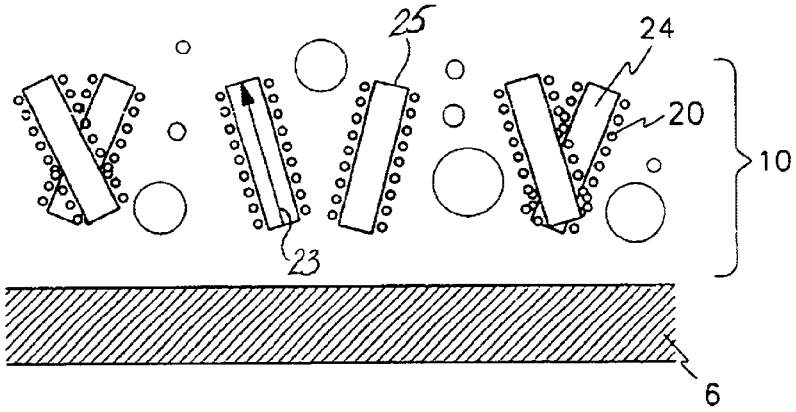
FIG. 2 is an enlarged sectional view of the emitter shown in FIG. 1.

FIG. 2 is an enlarged sectional view of the emitter 10. The emitter 10 is formed with an electron emission member 24 and an alignment member 20 for aligning the electron emission member 24. The electron emission member 24 is formed with fine pillar-shaped carbon fibers. The alignment member 20 is formed with a magnetic material that is magnetized under the influence of the magnetic field. The magnetic material may be selected from Fe, Ni, $Fe_2O_3$ or Co.

The magnetic material for the alignment member 20 is coated on the surface of the carbon fibers for the electron emission member 24. Alternatively, the magnetic material for the alignment member 20 may be incorporated into the internal structure of the carbon fibers for the electron emission member 24.

With the application of a magnetic field, the alignment member 20 aligns the electron emission member 24 in a predetermined direction. The electron emission member 24 is preferably aligned such that the longitudinal dimension 23 of the electron emission member 24 is vertically extended from the cathode 6 toward the phosphor screen 12 of the anode 8. In this structure, an end portion 25 of the electron emission member 24 is exposed to the vacuum atmosphere and directed toward the phosphor screen 12. The intensified electron emitting characteristic of the end portion 25 of the electron emission member 24 makes it possible to enhance the overall electron emitting characteristic of the emitter 10 even at the same voltage level.

Figure 3:
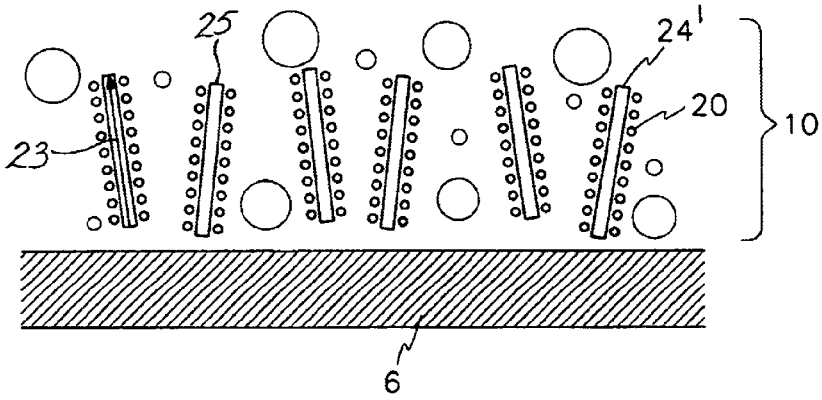
FIG. 3 is an enlarged sectional view of an emitter for a field emission display according to another preferred embodiment of the present invention.

FIG. 3 is an enlarged sectional view of an emitter for a field emission display according to a second preferred embodiment of the present invention. Other components of the field emission display are the same as those related to the first preferred embodiment except that the emitter 10 has a new electron emission member 24'. The electron emission member 24' is formed with plate-shaped graphite particles. With the addition of the alignment member 20, the electron emission member 24 is aligned in a predetermined direction with the same effects as in the first preferred embodiment.

A method of fabricating the field emission display will be specifically described with reference to FIGS. 4 and 5.

Figure 4:
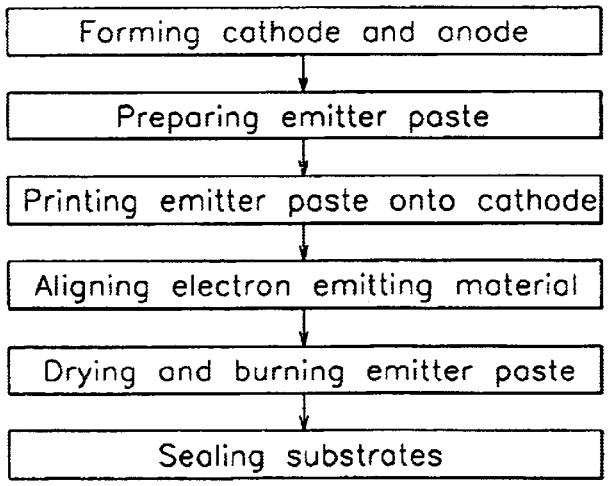
FIG. 4 is a processing flowchart sequentially illustrating the steps of fabricating the field emission display shown in FIG. 1.

FIG. 4 is a processing flowchart illustrating the steps of fabricating the field emission display. As shown in FIG. 4, the method of fabricating the field emission display roughly includes the steps of, 1) forming a cathode and an anode each through depositing a conductive layer onto a suitable substrate, 2) preparing an emitter paste through mixing an electron emitting material, a magnetic material and additives such as a frit and a binder, 3) screen-printing the emitter paste onto the cathode, 4) aligning the electron emitting material through forming a magnetic field in the vicinity of the printed emitter paste such that the electron emitting material can be arranged substantially vertical to the cathode, 5) solidifying the emitter paste through drying and burning it, and 6) sealing the substrates into one body.

Specifically speaking, indium tin oxide is first sputtered onto the substrate, and etched to thereby form an anode having a plurality of linear electrode portions.

Red, green and blue phosphors are screen-printed onto the anode, and heat-treated to thereby form a phosphor screen. A spacer paste is printed in-between the phosphors, and heat-treated to thereby form a spacer.

Indium tin oxide or silver is sputtered and screen-printed onto a substrate to thereby form a cathode having a plurality of linear electrode portions. A spacer paste is screen-printed in-between the linear electrode portions of the cathode, and heat-treated to thereby form a spacer.

A magnetic material such as Fe, Ni, $Fe_2O_3$ or Co is plated or coated onto carbon fibers for emitting electrons by using a technique known in the relevant art. Alternatively, the magnetic material may be incorporated into the internal structure of the carbon fibers by adding it into precursors of the carbon fibers.

The carbon fibers containing the magnetic material are then cut and pulverized to thereby form a carbon fiber powder. Then, additives such as a frit and a binder are mixed with the carbon fiber powder to thereby prepare an emitter paste having a predetermined viscosity.

The emitter paste is printed onto the cathode in a predetermined pattern. The paste printing is performed by a thick filming process including a screen printing technique. With the application of such a thick filming process, the emitter can be easily and uniformly formed with a desired pattern. This means that the processing steps can be effectively simplified.

Figure 5:
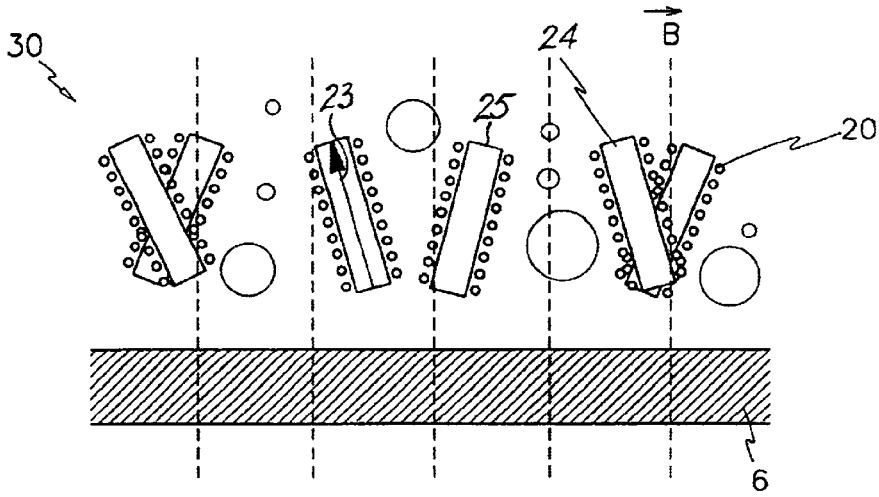
FIG. 5 is an enlarged sectional view of the emitter shown in FIG. 1 illustrating an electron emitting material aligning procedure.

As shown in FIG. 5 where reference numeral 30 indicates the printed emitter paste, a magnetic field B is formed between the bottom and top sides of the printed emitter paste 30. The direction of the magnetic field is established to be perpendicular to the cathode 6.

Under the influence of the magnetic field B, the magnetic material of the alignment component 20 is magnetized to thereby align the carbon fiber components of the electron emission member 24 in the direction of the magnetic field B.

Thereafter, the emitter paste 30 is dried and burned to thereby form the emitter 10.

The electron emitting material may also be formed with graphite particles. The graphite-based emitter fabricating process is the same as the carbon fiber-based emitter fabricating process except that graphite particles are used instead of carbon fibers.

A sealing frit 16 is coated on the edges of the first and second substrates 2 and 4 while leaving a gas exhaust portion. In the sealing process, the plural-lined anode and cathode 6 and 8 are arranged perpendicular to each other and heat-treated under an appropriate pressurizing condition.

Thereafter, a vacuum pump is connected to the gas exhaust portion and causes the internal vacuum atmosphere of the substrates to be in the range of $10^{-4}$~$10^{-10}$ Torr. Finally, the gas exhaust portion is completely sealed.

In this way, the electron emitting material components of the emitter can be aligned substantially perpendicular to the cathode, and the end portions of the electron emitting material components can be exposed to the vacuum atmosphere and directed toward the anode, thereby producing good electron emitting effects.

As described above, the inventive emitter can effectively enhance electron emitting characteristics.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A field emission display comprising:

first and second substrates spaced apart from each other with a predetermined distance, the first substrate having a top surface and the second substrate having a bottom surface, the top surface of the first substrate facing the bottom surface of the second substrate;

a cathode disposed on the top surface of the first substrate, the cathode having a top surface and a bottom surface, the bottom surface of the cathode contacting the top surface of the first substrate;

an anode disposed on the bottom surface of the second substrate, the anode having a top surface and a bottom surface, the top surface of the anode contacting the bottom surface of the second substrate;

a phosphor screen formed on the bottom surface of the anode; and an emitter formed on the top surface of the cathode, the emitter facing the phosphor screen;

wherein the emitter comprises an electron emission member having a longitudinal dimension and an aspect ratio greater than one and an alignment member for aligning the electron emission member relative to the cathode;

wherein the alignment member is formed with a magnetic material.

2. A field emission display comprising:

first and second substrates spaced apart from each other with a predetermined distance, the first substrate having a top surface and the second substrate having a bottom surface, the top surface of the first substrate facing the bottom surface of the second substrate;

a cathode disposed on the top surface of the first substrate, the cathode having a top surface and a bottom surface, the bottom surface of the cathode contacting the top surface of the first substrate;

an anode disposed on the bottom surface of the second substrate, the anode having a top surface and a bottom surface, the top surface of the anode contacting the bottom surface of the second substrate;

a phosphor screen formed on the bottom surface of the anode; and an emitter formed on the top surface of the cathode, the emitter facing the phosphor screen;

wherein the emitter comprises an electron emission member having a longitudinal dimension and an aspect ratio greater than one, and an alignment member for aligning the electron emission member relative to the cathode;

wherein the alignment member is formed with a magnetic material; and wherein the electron emission member is aligned by the alignment member such that the longitudinal dimension of the electron emission member is substantially vertically extended from the cathode toward the phosphor screen of the anode.

3. The field emission display of claim 1 wherein the electron emission member is formed with carbon fibers.

4. The field emission display of claim 3 wherein the magnetic material is coated on the carbon fibers.

5. The field emission display of claim 2 wherein the electron emission member is formed with carbon fibers.

6. The field emission display of claim 5 wherein the magnetic material is coated on the carbon fibers.

7. The field emission display of claim 1 wherein the electron emission member is formed with graphite particles.

8. The field emission display of claim 7 wherein the magnetic material is coated on the graphite particles.

9. The field emission display of claim 2 wherein the electron emission member is formed with graphite particles.

10. The field emission display of claim 9 wherein the magnetic material is coated on the graphite particles.

11. A field emission display comprising:

first and second substrates spaced apart from each other;

a cathode disposed on the first substrate;

an anode disposed on the second substrate;

a phosphor screen disposed on the anode; and an emitter disposed on the cathode and facing the phosphor screen, the emitter comprising an electron emission member having a longitudinal dimension and an aspect ratio greater than one, and an alignment member to align the electron emission member relative to the cathode, the alignment member comprising a magnetic material.

12. The field emission display of claim 11 wherein the electron emission member is aligned by the alignment member such that the longitudinal dimension of the electron emission member is substantially perpendicular to the cathode.

13. The field emission display of claim 1, wherein the emitter is a broad area emitter.

14. The field emission display of claim 2, wherein the emitter is a broad area emitter.

15. The field emission display of claim 11, wherein the emitter is a broad area emitter.

* * * * *